US010598051B2

(12) United States Patent
Bao et al.

(10) Patent No.: US 10,598,051 B2
(45) Date of Patent: Mar. 24, 2020

(54) ENERGY STORAGE SYSTEM

(71) Applicant: University of Newcastle Upon Tyne, Newcastle Upon Tyne, Tyne & Wear (GB)

(72) Inventors: Huashan Bao, Newcastle Upon Tyne (GB); Anthony Paul Roskilly, Newcastle Upon Tyne (GB)

(73) Assignee: University of Newcastle Upon Tyne, Newcastle upon Tyne, Tyne & Wear (GB)

( * ) Notice: Subject to any disclaimer, the term of this patent is extended or adjusted under 35 U.S.C. 154(b) by 95 days.

(21) Appl. No.: 16/067,163

(22) PCT Filed: Jan. 4, 2017

(86) PCT No.: PCT/GB2017/050008
§ 371 (c)(1),
(2) Date: Jun. 29, 2018

(87) PCT Pub. No.: WO2017/118851
PCT Pub. Date: Jul. 13, 2017

(65) Prior Publication Data

US 2019/0024539 A1 Jan. 24, 2019

(30) Foreign Application Priority Data

Jan. 4, 2016 (GB) ..... 1600091.1

(51) Int. Cl.
*F01K 25/08* (2006.01)
*F01K 3/12* (2006.01)
(Continued)

(52) U.S. Cl.
CPC ..... *F01K 25/08* (2013.01); *F01K 3/12* (2013.01); *F01K 25/00* (2013.01); *F25B 15/16* (2013.01);
(Continued)

(58) Field of Classification Search
CPC ..... F25B 17/08; F25B 15/16; F25B 27/02
See application file for complete search history.

(56) References Cited

U.S. PATENT DOCUMENTS 5,360,057 A * 11/1994 Rockenfeller ..... F25B 17/083 165/104.12
6,224,842 B1 * 5/2001 Rockenfeller ..... C09K 5/047 423/352
(Continued)

FOREIGN PATENT DOCUMENTS

| | | | |
|---|---|---|---|
| CN | 102337940 | A | 2/2012 |
| DE | 102009031238 | A1 | 1/2011 |
| GB | 352492 | A | 4/1930 |

OTHER PUBLICATIONS

Bao Huashan et al; "Integrated chemisorption cycles for ultra-low grade heat recovery and thermo-electric energy storage and exploitation"; Applied Energy, Elsevier Science Publishers, GB, vol. 164, Dec. 21, 2016, pp. 228-236.
(Continued)

*Primary Examiner* — Matthew J Merkling
(74) *Attorney, Agent, or Firm* — Nexsen Pruet, PLLC; E. Eric Mills

(57) ABSTRACT

There is disclosed an energy storage system. In particular, there is disclosed a chemisorption based energy storage system, able to provide electricity, heating or cooling depending on the desired energy output. The energy storage system includes a first chemical reactor containing a first sorbent material and a second chemical reactor containing a second sorbent material. The first and second chemical reactors are in mutual fluid connection such that a refrigerant fluid can flow from the first chemical reactor to the second chemical reactor, and from the second chemical reactor to the first chemical reactor. The first and second chemical reactors are further provided with means for putting heat in
(Continued)

to, or taking heat out of, the first and/or the second chemical reactors. A heat exchanger module is also provided. The heat exchanger module is configured to select from a plurality of available heat sources, a heat source having the highest temperature and an expander module selectively connected to the first chemical reactor and the second chemical reactor via the heat exchanger module. The heat source is arranged to heat the refrigerant fluid prior to the refrigerant fluid passing through the expander module, and the heat exchanger is configured to recover a surplus heat from the highest temperature heat source. The expander module is configured to expand the refrigerant fluid. The means for putting heat in to, or taking heat out of, the first and/or the second chemical reactors provides a flow of refrigerant fluid between the expander module and the first and second chemical reactors, and wherein the expander module is operable to expand the refrigerant fluid to provide a variable work output depending on energy storage requirements.

12 Claims, 7 Drawing Sheets

(51) Int. Cl.
*F01K 25/00* (2006.01)
*F25B 15/16* (2006.01)
*F25B 17/08* (2006.01)
*F25B 27/02* (2006.01)

(52) U.S. Cl.
CPC ..... *F25B 17/08* (2013.01); *F25B 27/02* (2013.01); *F25B 2400/14* (2013.01)

(56) References Cited

U.S. PATENT DOCUMENTS

| | | | | |
|---|---|---|---|---|
| 2003/0014982 | A1* | 1/2003 | Smith | C09K 5/047 62/106 |
| 2006/0120036 | A1* | 6/2006 | Rockenfeller | H05K 7/20836 361/688 |
| 2016/0238286 | A1* | 8/2016 | Rockenfeller | F25B 17/083 |

OTHER PUBLICATIONS

Bao Huashan et al; "An optimised chemisorption cycle for power generation using low grade heat"; Applied Energy, vol. 186, Jun. 28, 2016, pp. 251-261.

* cited by examiner

ENERGY STORAGE SYSTEM

CROSS REFERENCE TO RELATED APPLICATIONS

This application is a 35 U.S.C. § 371 U.S. national phase entry of International Application No. PCT/GB2017/050008 having an international filing date of Jan. 4, 2017, which claims the benefit of Great Britain Application No. 1600091.1 filed Jan. 4, 2016, each of which is incorporated herein by reference in its entirety.

There is disclosed an energy storage system. In particular, there is disclosed a chemisorption based energy storage system, able to provide electricity, heating or cooling depending on the desired energy output.

BACKGROUND

The development of energy storage is necessary in order to reduce our dependency on fossil fuels and to improve our ability to store energy produced by energy sources where the energy output is controlled by weather rather than energy needs. Energy sources such as wind and wave may produce an excess of energy when the demand for energy is low, such as during the night, and the ability to efficiently store the excess energy until the demand increases is required.

There are several types of energy storage currently used, the type used depends upon the quantities of energy storage required as some energy storage types become astronomically expensive or unachievably large. Conventional compressed air energy storage (CAES) is useful for large scale energy storage such as grid scale, from around ten to 300 megawatts. In principle, a CAES system in combination with a wind farm connected to the grid, for example, is able to store energy underground by compressing air and storing the compressed air in an impermeable cave when the energy produced by the wind farm is not required by the demands on the grid. When energy demands increase, the compressed air in the cave is released and is used to produce electricity. Because conventional CAES systems require specific geological conditions, the location of CAES sites is limited.

WO2010138677 discloses an adsorption enhanced compressed air energy system whereby the storage vessels are provided with porous materials such as carbon, silica gel or zeolites. The compressed fluid are more easily stored in the presence of the porous material because the absorbed phase is much denser than the free fluid, thus reducing the volume of the storage tank required.

BRIEF SUMMARY OF THE DISCLOSURE

Viewed from a first aspect, there is provided a chemisorption based energy storage device comprising:

a first chemical reactor containing a first sorbent material and a second chemical reactor containing a second sorbent material, the first and second chemical reactors being in mutual fluid connection such that a refrigerant fluid can flow from the first chemical reactor to the second chemical reactor, and from the second chemical reactor to the first chemical reactor, the first and second chemical reactors being further provided with means for putting heat in to, or taking heat out of, the first and/or the second chemical reactors;

a heat exchanger module, the heat exchanger module being configured to select from a plurality of available heat sources, a heat source having the highest temperature; and an expander module selectively connected to the first chemical reactor and the second chemical reactor via the heat exchanger module;

wherein the heat source is arranged to heat the refrigerant fluid prior to the refrigerant fluid passing through the expander module, and wherein the heat exchanger is configured to recover a surplus heat from the highest temperature heat source, and the expander module is configured to expand the refrigerant fluid;

wherein the means for putting heat in to, or taking heat out of, the first and/or the second chemical reactors provides a flow of refrigerant fluid between the expander module and the first and second chemical reactors, and wherein the expander module is operable to expand the refrigerant fluid to provide a variable work output depending on energy storage requirements.

The refrigerant fluid is adsorbed onto the first or second sorbent material when the first or second sorbent material is subject to a temperature lower than the equilibrium temperature of the first or second sorbent-refrigerant reaction at the working pressure, wherein the working pressure is the pressure of the system. The refrigerant fluid is desorbed from the first or second sorbent material when the first or second sorbent material is subject to a temperature higher than the equilibrium temperature of the first or second sorbent-refrigerant reaction at the working pressure.

The first sorbent material has a first optimum desorption temperature range corresponding to a given range of heat source temperature if the heat sink temperature is fixed.

The second sorbent material has a second optimum desorption temperature range corresponding to a given range of heat source temperature if the heat sink temperature is fixed.

A surplus heat exists when the highest heat source has a temperature greater than the first optimum desorption temperature of the first chemical reactor or greater than the second optimum desorption temperature of the second chemical reactor.

The first and second optimum desorption temperature ranges may be different.

The first and second optimum desorption temperature ranges may have some overlap.

The first and second optimum desorption temperature ranges may be substantially the same.

If the heat source temperature is greater than the optimum desorption temperature of the first chemical reactor or greater than the optimum desorption temperature of the second chemical reactor, the heat exchanger recovers the surplus heat from the highest temperature heat source.

By identifying the first and second optimum desorption temperature ranges for the first and second sorbent materials respectively, power generation, thermal efficiency and energy efficiency of the system is improved.

If the means for putting heat in to the first sorbent material heats the first sorbent material to a temperature higher than the first equilibrium temperature of the first sorbent-refrigerant reaction at a given working pressure, while the means for taking heat out of the second sorbent material cools the second material to a temperature lower than the second equilibrium temperature of the second sorbent-refrigeration reaction at the given working pressure, the refrigerant fluid is desorbed from the first sorbent material, and flows to the second sorbent material and is adsorbed into the second sorbent material.

If the means for putting heat in to the second sorbent material heats the second sorbent material to a temperature higher than the second equilibrium temperature of the second sorbent-refrigerant reaction at a given working pressure, while the means for taking heat out of the first sorbent material cools the first material to a temperature lower than the first equilibrium temperature of the first sorbent-refrigeration reaction at the given working pressure, the refrigerant fluid is desorbed from the second sorbent material, and flows to the first sorbent material and is adsorbed into the first sorbent material.

A heat exchanger is provided to enable the system to recover waste heat continuously so that mechanical energy may be generated efficiently and continuously throughout one complete cycle while at the same time providing cooling or heating.

Optionally, the first sorbent material may be a salt, e.g. a metal salt. The salt may be selected from salts which are able to form dative bonds with refrigerant fluids, e.g. ammonia, methanol or steam. The salt may be a metal halide, e.g. a metal chloride or a metal bromide. Metal halide salts are well suited to systems in which the refrigerant fluid is ammonia, methanol or steam.

The salt may be a metal sulphide. Metal sulphide salts are well suited to systems in which the refrigerant fluid is steam.

The salt may be a metal sulphate. Metal sulphate salts are well suited to systems in which the refrigerant fluid is ammonia or steam.

The salt may be selected from the group: $NiCl_2$, $CaCl_2$, $SrCl_2$, $FeCl_2$, $FeCl_3$, $ZnCl_2$, $MgCl_2$, $MgSO_4$ and $MnCl_2$ Optionally, the second sorbent material may be a salt, e.g. a metal salt. The salt may be selected from salts which are able to form dative bonds with refrigerant fluid, e.g. ammonia, methanol or steam.

The salt may be a metal halide, e.g. a metal chloride or a metal bromide. Metal halide salts are well suited to systems in which the refrigerant fluid is ammonia, methanol or steam.

The salt may be a metal sulphide. Metal sulphide salts are well suited to systems in which the refrigerant fluid is steam.

The salt may be a metal sulphate. Metal sulphate salts are well suited to systems in which the refrigerant fluid is ammonia or steam.

The salt may be $CaCl_2$, $SrCl_2$, $BaCl_2$, NaBr, $NH_4Cl$, $PbCl_2$, LiCl, and $Na_2S$.

Provided the first sorbent material and the second sorbent material have interactions with the refrigerant fluid such that the refrigerant fluid is able to adsorb to the first and the second sorbent materials, the first and second sorbent materials may be the same type (e.g. both are metal halides), or a mix of salts (e.g. one metal halide, one metal sulphide). The salt selection must be compatible in that the first and second equilibrium temperatures of each salt should be compatible. Thus, a further benefit of the system is that there are numerous working pairs capable of refrigeration and heat output within different temperature ranges and therefore the energy storage system may include working salt pairs operating at different temperatures further expanding the usability of system.

Optionally, the refrigerant may be ammonia.

Ammonia is wet fluid and is therefore not ideal as a working fluid for power generation. However, based on adsorption thermodynamics, heat exchangers allow better management and effective utilisation of waste heat source in the system and also offer significant improvement on the cycle thermal and energy efficiency.

By incorporating heat exchanger, and identifying a first and second optimum desorption temperature, as any surplus heat may be imposed on the heat exchanger. Furthermore, since a heat exchanger is provided for the entire cycle, the efficiency of the whole cycle of the system is improved.

Optionally, the refrigerant may be methanol.

Optionally, the refrigerant may be steam.

Refrigerants such as ammonia, methanol and steam have reduced or zero ozone depletion potential (ODP) and zero global warming potential (GWP) and therefore an energy storage system comprising refrigerants such those used in the present energy storage system is advantageous over existing energy storage systems using more environmentally harmful refrigerants. The principle of the desorption-reheating process relies on the identification of the optimum desorption point of the first sorbent material and the second sorbent material under different heat source conditions. The heat exchanger enables the system to manage the thermal energy of different available heat source temperature levels while increasing work output.

Viewed from a second aspect, there is provided a method of operating an energy storage system according to the first aspect, the method comprising:

providing a first chemical reactor containing a first sorbent material and a second chemical reactor containing a second sorbent material, the first and second chemical reactors being in mutual fluid connection such that a refrigerant fluid can flow from the first chemical reactor to the second chemical reactor, and from the second chemical reactor to the first chemical reactor, the first and second chemical reactors being further provided with means for putting heat in to, or taking heat out of, the first and/or the second chemical reactors;

providing a heat exchanger module, the heat exchanger module being configured to select from a plurality of available heat sources, a heat source having the highest temperature; and selectively connecting an expander module to the first chemical reactor and the second chemical reactor via the heat exchanger module;

heating the refrigerant fluid via the selected highest temperature heat source and passing the refrigerant fluid through the expander module;

recovering a surplus heat from the highest temperature heat source; and expanding the refrigerant fluid through the expander module;

wherein the means for putting heat in to, or taking heat out of, the first and/or the second chemical reactors provides a flow of refrigerant fluid between the expander module and the first and second chemical reactors, and wherein the expander module is operable to expand the refrigerant fluid to provide a variable work output depending on energy storage requirements.

BRIEF DESCRIPTION OF THE DRAWINGS

Embodiments of the invention are further described hereinafter with reference to the accompanying drawings, in which.

DETAILED DESCRIPTION

Often, several heat sources or streams of waste heat are available in industrial processes. The heat sources often have different temperatures. The heat sources can be arranged and selected for the energy storage system based on optimum desorption temperatures for the first and second chemical reactor.

The energy storage system includes a first chemical reactor containing a material that can adsorb the refrigerant fluid when it is subject to a temperature lower than the first equilibrium temperature of the chemical reaction between the first sorbent material and the refrigerant fluid at a given working pressure. If the temperature is greater than the first equilibrium temperature the refrigerant fluid will desorb from the first chemical reactor.

A second chemical reactor is provided comprising a second sorbent material that can adsorb the refrigerant fluid when it is subject to a temperature lower than the equilibrium temperature of the reaction between the second sorbent material and the refrigerant fluid at a given working pressure. If the temperature is greater than the second equilibrium temperature the refrigerant fluid will desorb from the second chemical reactor.

The energy storage system has access to heat sources or alternatively, objects which require refrigeration.

The energy storage system further includes an expander module selectively connected to the first chemical reactor and the second chemical reactor via a heat exchanger module. The expander module is configured to expand the refrigerant fluid to produce mechanical work output. Refrigerant fluid, such as ammonia for example, flows between the expander module and the first and second chemical reactors. The expander module is able to expand the refrigerant fluid to provide a variable work output depending on energy storage requirements.

Figure 1:
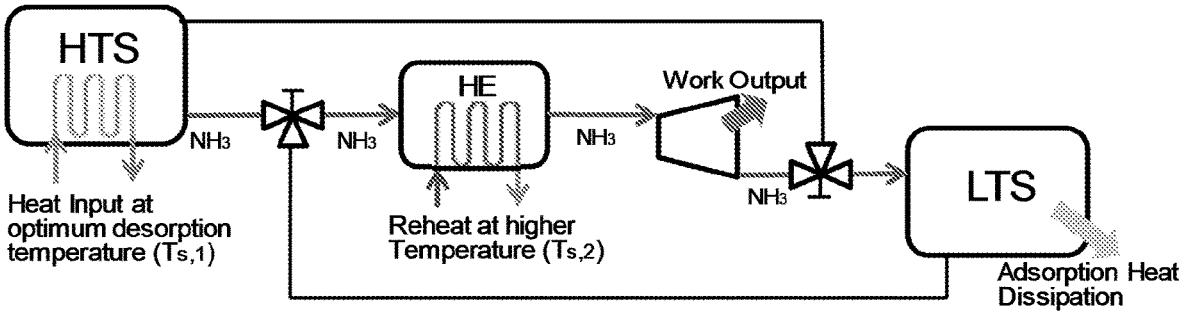
FIG. 1 shows an example of a first half cycle for mechanical work output in an energy storage system.

FIG. 1 shows an example of a first half cycle of an energy storage system. It has been found by the Applicants that and energy storage system as shown in FIGS. 1 to 4 comprising a first and second chemical reactor, has a first optimum desorption temperature range for the first chemical reactor and a second optimum desorption temperature range for the second chemical reactor under a given condition of heat source, heat sink and working pressure, whereby the refrigerant fluid desorbed from the first or the second chemical reactors can produce the maximum mechanical work output, leading to the improved energy efficiency. By incorporating a heat exchanger into each of the first half cycle and the second half cycle (see for example, FIGS. 1 to 4), several heat sources may be efficiently used within the energy storage system.

The optimum desorption temperature may be the same temperature as the available heat source, or the optimum desorption temperature may be higher or lower than the temperature of the available heat source.

The optimum temperature desorption is identified for the chemical reactor in order to obtain maximum power generation. In the first half cycle heat is put into the system at the first chemical reactor at the optimum desorption temperature $Ts_1$ of the first chemical reactor. Ammonia is desorbed from the first chemical reactor at the desorption temperature $Ts_1$, and is subsequently reheated by the heat exchanger by a higher temperature heat source, before the refrigerant fluid is expanded to generate mechanical energy. After the ammonia is expanded, the ammonia is adsorbed into the second chemical reactor.

Figure 2:
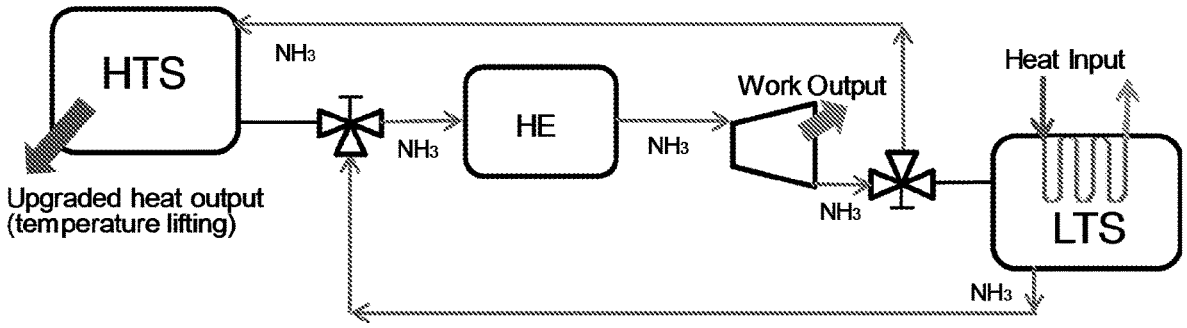
FIG. 2 shows an example of a second half cycle for mechanical work output and a thermal transformer.

FIG. 2 shows an example of a second half cycle of the energy storage system. Coupled with the first half cycle shown in FIG. 1, this arrangement is configured to provide continuous power generation and a batched thermal transformer in a complete cycle.

The second chemical reactor is heated up at the second optimum desorption so that ammonia is desorbed from the second reactor. The ammonia passes through the heat exchanger before the desorbed ammonia entrains to the expander and expands to generate mechanical energy. Exhausted ammonia from the expander is adsorbed into the first chemical reactor. The exhausted ammonia from the expander is at high temperature and high pressure, and therefore there is great potential for the ammonia adsorption in first chemical reactor to produce upgraded heat at higher temperature than the temperature of the available heat source.

Figure 3:
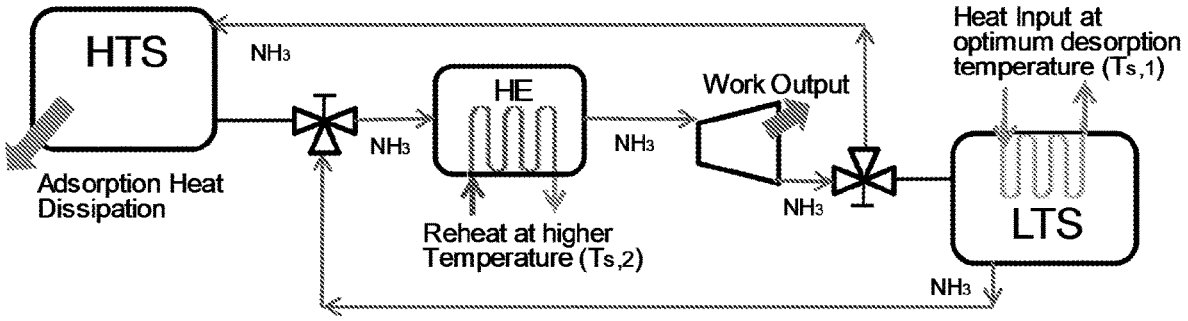
FIG. 3 shows an example of a second half cycle for mechanical work output.

FIG. 3 shows an alternative operation of the energy storage system, providing continuous optimum power generation in a complete cycle if coupled with the first half cycle shown in FIG. 1. The second chemical reactor is heated at the second optimum desorption temperature such that ammonia is desorbed from the second chemical reactor. The desorbed ammonia is subsequently reheated by the heat exchanger up to higher temperature by a heat source. The desorbed ammonia expands to generate mechanical energy before it is adsorbed into the first chemical reactor. Adsorption heat released from first chemical reactor is discharged to ambient environment thereby providing a heat source, or discharged to a cooler sink.

Figure 4:
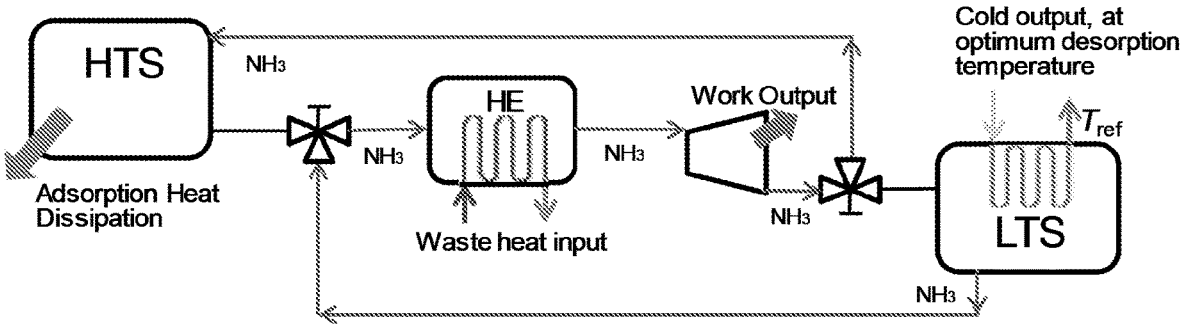
FIG. 4 shows an example of a second half cycle for mechanical work output and cooling.

FIG. 4 shows a further alternative operation of the energy storage system, providing continuous optimum power generation and batched cooling in a complete cycle if coupled with the first half cycle shown in FIG. 1. The second chemical reactor extracts heat at the second optimum desorption temperature from the objects to be cooled and thereby produces a cooling effect for the objects. For some resorption metal salt working pairs, the optimum desorption temperature which is again identified to maximise work output by the expander, happens to be low enough to produce an additional cooling effect.

Figure 5:
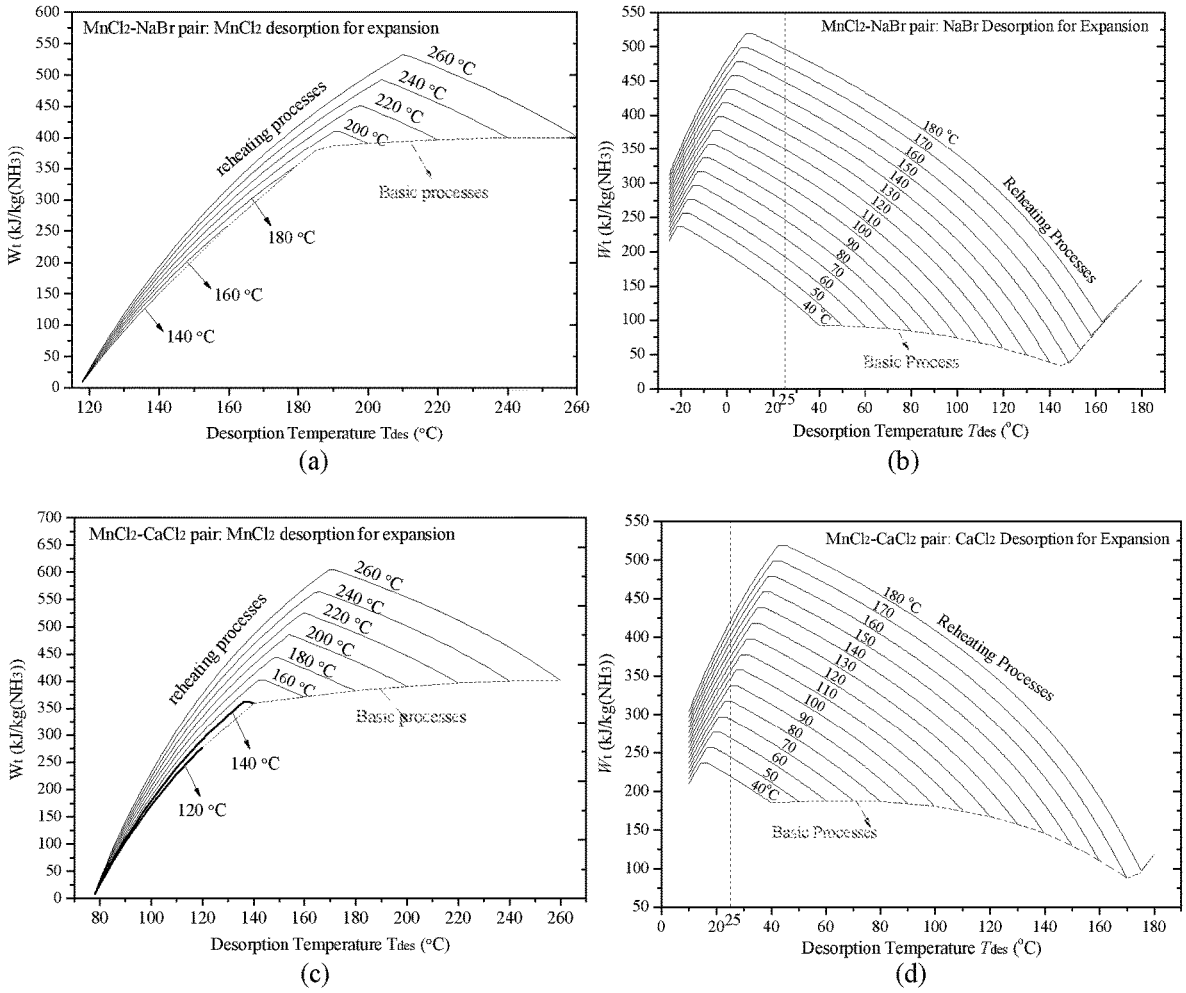
FIG. 5 shows a simulation result of the work output of the desorption-reheating process under conditions of different heat source temperature for different salt pairs when the heat sink temperature is at 25° C. Work output of the desorption-reheating process under conditions of different heat source temperature when the heat sink temperature is at 25° C. is shown: (a) $MnCl_2$—NaBr pair, the optimum desorption temperature of the first salt; (b) $MnCl_2$—NaBr pair, the optimum desorption temperature of the second salt; (c) $MnCl_2$—$CaCl_2$ pair, the optimum desorption temperature of the first salt; (d) $MnCl_2$—$CaCl_2$ pair, the optimum desorption temperature of the second salt.

For example, using the metal salt pair of $MnCl_2$ (first chemical reactor) and NaBr (second chemical reactor), the work output against desorption temperature in the first half cycle and the second half cycle is shown in FIG. 5 (*a*) and FIG. 5 (*b*), respectively. The Figure shows peaks at certain temperature points, depending on different waste heat source temperatures. The peaked temperature points in FIG. 5(*b*), represent the optimum desorption temperature of the second chemical reactor, and are lower than ambient temperatures (marked as the vertical dashed line in FIG. 5). This implies the potential of cooling generation. The red curves marked as "basic process" represent power generation of the prior art system, the TR-CAES system described in the background section of the present application.

Referring back to the example of the second half cycle shown in FIG. 4, after desorption of ammonia in the second chemical reactor, the desorbed ammonia is heated by available waste heat and subsequently the ammonia passes through the expander to generate mechanical energy. Adsorption heat is released from first chemical reactor and discharged to ambient environment or to a cooler sink.

The first chemical reactor may be considered as a high temperature salt chemical reactor and the second chemical reactor may be considered as a low temperature salt chemical reactor.

The desorption and reheating process can be conducted in an optimised manner by first identifying the first and second optimum desorption temperature of the first and second chemical reactors under a given condition of heat source and heat sink. In some situations, there is only one heat source at a certain temperature, the energy storage system may still use this single heat source in a heat exchange arrangement, e.g. the heat source firstly supplies reheating to the heat exchanger then the exhausted heat from the heat exchanger is used for the chemical reactor to instigate desorption of ammonia. Alternatively it is also possible to achieve the required temperature levels by controlling the flow rate of the heat source fluid or the heat exchanging fluid passing through the heat exchanger. Furthermore, if the optimum desorption temperature is lower than ambient temperature, refrigeration is achieved as shown in FIG. 4.

Figure 6:
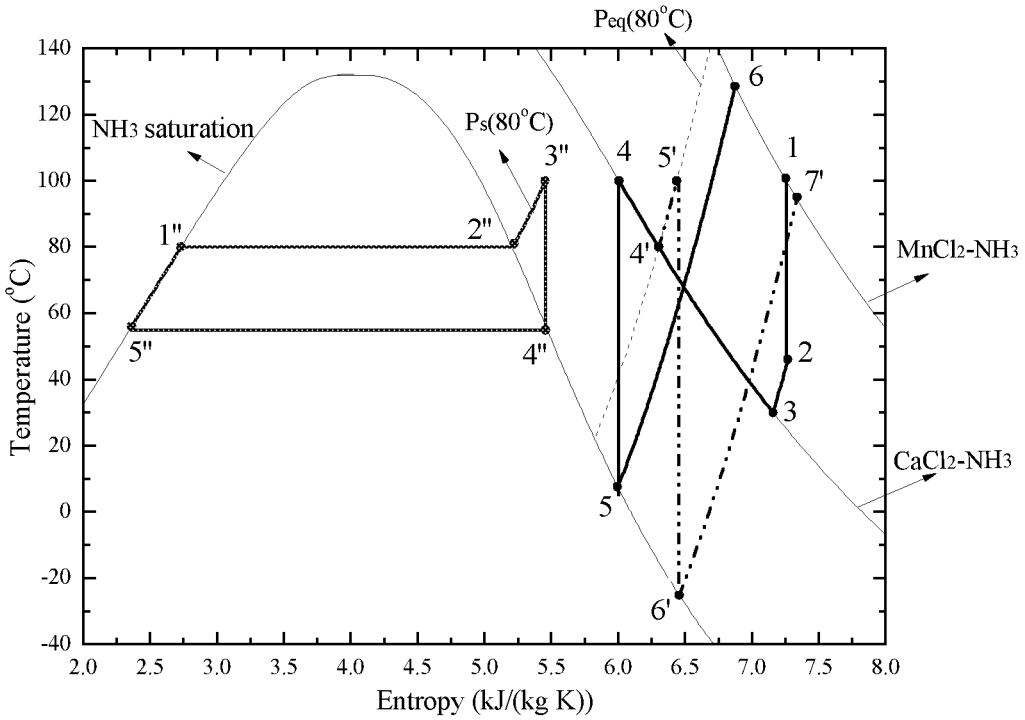
FIG. 6 shows the ideal thermodynamic cycle of thermochemical power generation in an energy storage system using for example a salt pair of $MnCl_2$—$CaCl_2$ and the ideal thermodynamic cycle of an ammonia based Rankine cycle in the diagram of the temperature versus entropy of the ammonia.

FIG. 6 shows the ideal thermodynamic cycle of a number of examples in a diagram of temperature versus entropy including the Rankine cycle using ammonia as the working fluid. In the Rankine cycle (shown as tracks 1"-2"-3"-4"-5"), 2"-3" shows the superheating process (from 80 degrees C. to 100 degrees C.) and the 3"-4" is the isentropic expansion. Ammonia is a wet fluid and the thermodynamic state of the superheated ammonia vapour is still close to the saturation condition, therefore, the vapour expansion is limited, leading to limited work output.

The thermochemical power generation cycle using $MnCl_2$—$CaCl_2$ pair without reheating process is shown as tracks 1-2-3-4-5-6, where 1-2 process is the isentropic expansion when the desorption temperature is at 100° C. (for example, 100° C. is the available highest heat source temperature) for $MnCl_2$ ammoniate. Because the optimum desorption temperature of $MnCl_2$ ammoniate is the same as the available highest heat source temperature (100° C.), no reheating is carried out in this first half cycle. 2-3 shows the isobaric adsorption in the $CaCl_2$ reactor. In the second half cycle, 4-5 shows the isentropic expansion if the desorption temperature is at 100° C. for $CaCl_2$ ammoniate without reheating, 5-6 shows the isobaric adsorption in the $MnCl_2$ reactor. The thermochemical power generation cycle using $MnCl_2$—$CaCl_2$ pair with reheating process is shown as tracks 1-2-3-4'-5'-6'-7'. Because the optimum desorption temperature of $CaCl_2$ ammoniate in this example is lower than the available highest heat source temperature (100° C.), if the reheating process (4'-5') is introduced in this second half cycle, e.g. when desorption temperature is at 80° C. and the reheat temperature is at 100° C., the work output increases to (5'-6'), higher than (4-5), much higher than (3"-4"). The equilibrium of the chemical reaction between salts and ammonia is far away from a saturation condition so that there is more potential of fluid expansion. Because there are two restricting factors for thermochemical power generation, the saturation condition and the backpressure (adsorption pressure on the other side), there is a balance between these two factors, therefore leading to an optimum condition of desorption temperature corresponding to different highest heat source temperature for maximum work output.

In an example, if the working pair $MnCl_2$—NaBr is used and the heat sink temperature is at 25° C., the first optimum temperature for the first sorbent material ($MnCl_2$) ranges from 140° C. to 210° C. when the heat source is from 140° C. to 260° C.; the second optimum temperature for the second sorbent material (NaBr) ranges from −20° C. to 9° C. when the heat source temperature is from 40° C. to 180° C.

In another example, if the working pair $MnCl_2$—$CaCl_2$ is used and the heat sink temperature is at 25° C., the first optimum temperature for the first sorbent material ($MnCl_2$) ranges from 120° C. to 170° C. when the heat source is from 140° C. to 260° C.; the second optimum temperature for the second sorbent material ($CaCl_2$) ranges from 14° C. to 45° C. when the heat source temperature is from 40° C. to 180° C.

It should be noted that for power generation, the resorption adsorbent pair can consist of two same salt, like $CaCl_2$—$CaCl_2$ pair, $MnCl_2$—$MnCl_2$ pair; for cooling and heating purpose, there must be two different salts to group a pair, like $MnCl_2$—$CaCl_2$ pair, $MnCl_2$—NaBr pair.

The vapour isentropic expansion in the resorption cycle is limited by two factors. The first is the saturation condition of the working fluid (such as $NH_3$), the other limiting factor is the expansion backpressure which relates to the equilibrium pressure of the salt-ammoniate adsorption.

Figure 7:
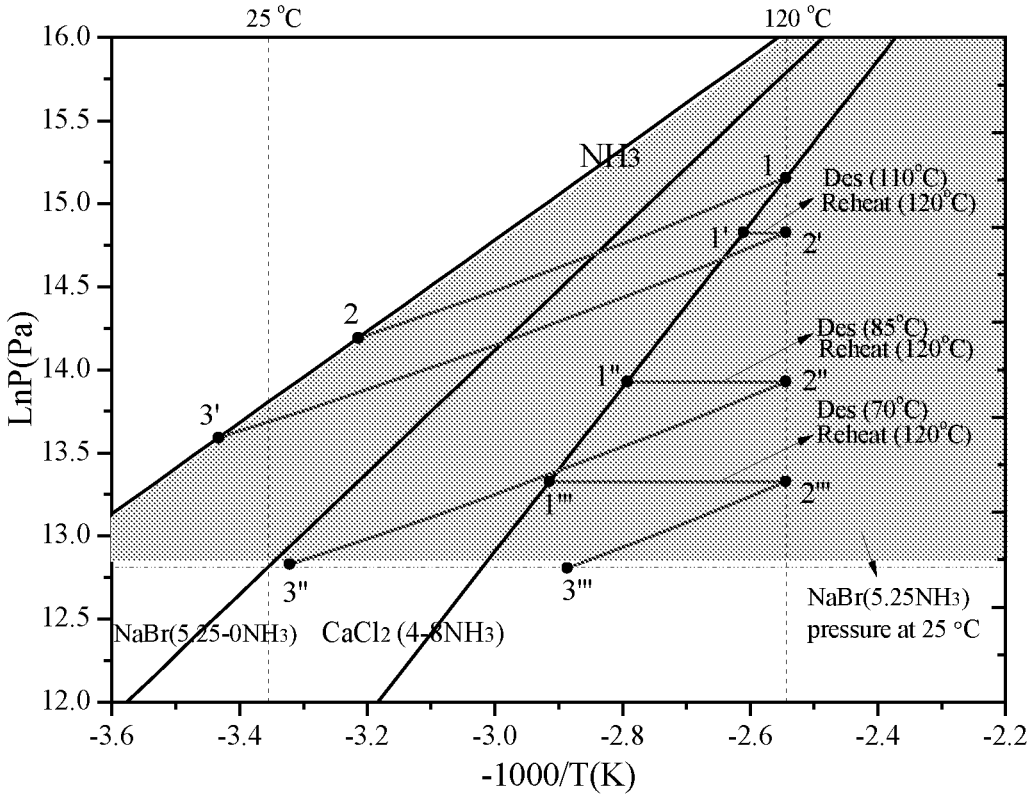
FIG. 7 shows ideal theoretical analysis of the desorption-expansion process in resorption power generation cycle.

FIG. 7 shows the resorption cycle using a $CaCl_2$—NaBr working pair in the energy storage system. FIG. 7 shows an ideal theoretical analysis of the first half cycle, $CaCl_2$ is the first sorbent material (or the high temperature salt, HTS) while the NaBr is the second sorbent material (low temperature salt, LTS). Due to the limiting factors mentioned above, the expansion state should be located in the grey-colour-marked domain as shown in the graph of FIG. 7, which is the area on the right hand side of $NH_3$ saturation line and above the adsorption equilibrium pressure line of NaBr ammoniate at a heat sink temperature (assumed 25° C. in this example).

This implies that the expansion exhaust remains in a vapour phase and at a pressure higher than the backpressure.

When the heat source is at a temperature of around 120° C. is used to heat the $CaCl_2$ ammoniate (assuming that this is the highest temperature heat source available), the vapour expansion of the desorbed ammonia from $CaCl_2$ ammoniate starts from the equilibrium state at point 1 as shown in FIG. 7. The isentropic expansion curve 1-2 therefore represents the ideal maximum potential of work generation when the 120° C. heat source is directly used for desorption.

If a reheating process is introduced, using a lower temperature for desorption (<120° C.) and then reheating the desorbed vapour isobarically to a higher temperature level with a 120° C. heat source, the final work output from the vapour expansion would change. There are three examples of reheating process shown in FIG. 7, where the Applicant has used different desorption temperatures but the same reheating temperature. The curve 1'-2'-3' represents the process of desorption at 110° C. and isobaric reheating process at 120° C., while the curve 1"-2"-3" represents the process of desorption at 85° C. and reheating at 120° C., the curve 1'''-2'''-3''' represents the process of desorption at 70° C. and reheating at 120° C.

It is clear that the expansion potential in the order as (1'-2'-3')>(1''-2''-3'')>(1-2)>(1'''-2'''-3'''). According to a calculation based on thermodynamic equilibrium of resorption process and isentropic expansion, the Applicant has found that the varying profile of the expansion work output against the desorption temperature is a peaked curve (as shown in FIG. 5). The work output firstly increases as the desorption temperature decreases and reaches its vertex at a certain desorption temperature. Afterwards the expansion work output starts to decrease as the desorption temperature further decreases. Therefore there is an optimal desorption temperature for maximum work output if a reheating process applies, as a result of the balancing between the two limiting factors as aforementioned in the resorption processes.

In another example, if the available heat source has a temperature equivalent to the optimum desorption temperature, there would be a monotone declining trend of the work output if a reheating applies and the desorption temperature decreases. The method to identify the optimum point applies for either case, and is necessary for identifying the optimum performance of the energy storage system.

It will be clear to a person skilled in the art that features described in relation to any of the embodiments described above can be applicable interchangeably between the different embodiments. The embodiments described above are examples to illustrate various features of the invention Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A chemisorption based energy storage device comprising:

a first chemical reactor containing a first sorbent material and a second chemical reactor containing a second sorbent material, the first and second chemical reactors being in mutual fluid connection such that a refrigerant fluid can flow from the first chemical reactor to the second chemical reactor, and from the second chemical reactor to the first chemical reactor, the first and second chemical reactors being further provided with means for putting heat in to, or taking heat out of, the first and/or the second chemical reactors;

a heat exchanger module, the heat exchanger module being configured to select from a plurality of available heat sources, a heat source having the highest temperature; and an expander module selectively connected to the first chemical reactor and the second chemical reactor via the heat exchanger module;

wherein the heat source is arranged to heat the refrigerant fluid prior to the refrigerant fluid passing through the expander module, and wherein the heat exchanger is configured to recover a surplus heat from the highest temperature heat source, and the expander module is configured to expand the refrigerant fluid;

wherein the means for putting heat in to, or taking heat out of, the first and/or the second chemical reactors provides a flow of refrigerant fluid between the expander module and the first and second chemical reactors, and wherein the expander module is operable to expand the refrigerant fluid to provide a variable work output depending on energy storage requirements.

2. An energy storage system according to claim 1, wherein the first sorbent material is a salt, and preferably, the first sorbent material is a metal halide.

3. An energy storage system according to claim 2, wherein the salt is a metal sulphide or a metal sulphate.

4. An energy storage system according to claim 1, wherein the first sorbent material is selected from the group: $NiCl_2$, $CaCl_2$, $SrCl_2$, $FeCl_2$, $FeCl_3$, $ZnCl_2$, $MgCl_2$, $MgSO_4$ and $MnCl_2$.

5. An energy storage system according to claim 1, wherein the second sorbent material is a salt, and preferably, the second sorbent material is a metal salt.

6. An energy storage system according to claim 5, wherein the salt is a metal halide.

7. An energy storage system according to claim 5, wherein the salt is a metal sulphide.

8. An energy storage system according to claim 5, wherein the salt is a metal sulphate.

9. An energy storage system according to claim 1, wherein the second sorbent material is selected from the group: $CaCl_2$, $SrCl_2$, $BaCl_2$, NaBr, $NH_4Cl$, $PbCl_2$, LiCl, and $Na_2S$.

10. An energy storage system according to claim 1, wherein the refrigerant fluid is selected from the group: ammonia, methanol, and steam.

11. A method of operating an energy storage system according to the first aspect, the method comprising:

providing a first chemical reactor containing a first sorbent material and a second chemical reactor containing a second sorbent material, the first and second chemical reactors being in mutual fluid connection such that a refrigerant fluid can flow from the first chemical reactor to the second chemical reactor, and from the second chemical reactor to the first chemical reactor, the first and second chemical reactors being further provided with means for putting heat in to, or taking heat out of, the first and/or the second chemical reactors;

providing a heat exchanger module, the heat exchanger module being configured to select from a plurality of available heat sources, a heat source having the highest temperature; and selectively connecting an expander module to the first chemical reactor and the second chemical reactor via the heat exchanger module;

heating the refrigerant fluid via the selected highest temperature heat source and passing the refrigerant fluid through the expander module;

recovering a surplus heat from the highest temperature heat source; and expanding the refrigerant fluid through the expander module;

wherein the means for putting heat in to, or taking heat out of, the first and/or the second chemical reactors provides a flow of refrigerant fluid between the expander module and the first and second chemical reactors, and wherein the expander module is operable to expand the refrigerant fluid to provide a variable work output depending on energy storage requirements.

12. An energy storage system according to claim 1, wherein the refrigerant is selected from one of: ammonia, methanol or steam.

* * * * *